US008146185B2

(12) United States Patent
Berruit

(10) Patent No.: US 8,146,185 B2
(45) Date of Patent: Apr. 3, 2012

(54) STRUCTURE TO MAKE EASIER LAYING COVERS

(76) Inventor: Enrico Berruit, Calliano (IT)

( * ) Notice: Subject to any disclaimer, the term of this patent is extended or adjusted under 35 U.S.C. 154(b) by 0 days.

(21) Appl. No.: 12/918,464

(22) PCT Filed: Mar. 2, 2009

(86) PCT No.: PCT/IB2009/050829

§ 371 (c)(1),
(2), (4) Date: Oct. 14, 2010

(87) PCT Pub. No.: WO2009/107109

PCT Pub. Date: Sep. 3, 2009

(65) Prior Publication Data

US 2011/0119827 A1 May 26, 2011

(30) Foreign Application Priority Data

Feb. 29, 2008 (IT) ..... PV2008A0229

(51) Int. Cl.
*A47C 21/02* (2006.01)

(52) U.S. Cl. ..... 5/488; 5/482

(58) Field of Classification Search ..... 5/488, 482, 5/692, 503.1–506.1, 658
See application file for complete search history.

(56) References Cited

U.S. PATENT DOCUMENTS

| | | | | |
|---|---|---|---|---|
| 2,947,008 | A * | 8/1960 | Wild | 5/506.1 |
| 3,581,321 | A * | 6/1971 | Geary | 5/488 |
| 3,855,655 | A | 12/1974 | Propst | |
| 4,024,591 | A * | 5/1977 | Raczkowski | 5/488 |
| 4,441,222 | A * | 4/1984 | Tascarella | 5/488 |
| 2002/0170114 | A1 * | 11/2002 | Wolcott | 5/488 |
| 2011/0119827 | A1 * | 5/2011 | Berruti | 5/488 |

* cited by examiner

*Primary Examiner* — Robert G Santos
(74) *Attorney, Agent, or Firm* — Notaro, Michalos & Zaccaria P.C.

(57) ABSTRACT

The present invention concerns a bed (1) provided with a device (2) suitable for facilitating the straightening of blankets and sheets when making the bed. Said device (2) is of the type with a frame, or surround, comprising two rods (2*a*, 2*b*) and a third transverse rod (2*c*) which joins the second ends of said two rods (2*a*, 2*b*), capable of rotating around an axis (4) from a horizontal to a vertical position and vice versa, the axis of rotation (4) being horizontal, transverse with respect to the length of the bed and situated in the vicinity of the head (5) of the bed; means are provided suitable for hooking the covers (7) in the highest position of the frame, i.e. to said third transverse rod (2*c*) of said frame, when the latter is in the vertical position, said device (2) being characterized in that a further two short additional rods (2*d*, 2*e*) are provided, connected to the ends of said transverse rod of the frame, said additional rods (2*d*, 2*e*) being able, in turn, to assume a first position when said rods (2*d*, 2*e*) are aligned with said transverse rod (2*c*) so as to constitute an extension of said transverse rod (2*c*) suitable for gripping the part of said cover (7) exceeding the width of the mattress of said bed (1).

3 Claims, 6 Drawing Sheets

STRUCTURE TO MAKE EASIER LAYING COVERS

The present invention relates to a bed provided with a device suitable for facilitating the straightening of blankets and sheets when making the bed.

Various inventions are known aimed at facilitating and/or automating the daily routine operation of "making and/or re-making the bed".

The U.S. Pat. No. 3,855,655 "SELF-MAKING BED" (by Propst, Dec. 24, 1974), describes an automatic bed-making device. Said device consists essentially of a frame, or surround, suitable for rotating from a horizontal position to a vertical position and vice versa, the axis of rotation being horizontal, transverse with respect to the length of the bed and situated in the vicinity of the head of the bed. When the frame is in a vertical position, the covers, which are hooked to a transverse rod of the frame, i.e. to the highest part of the frame, will be straightened due to the effect of the force of gravity; during the rotation, which sets the frame from the vertical to the horizontal position, the covers are laid gradually on the mattress, achieving the purpose of the action.

This device applies to covers with width not exceeding the width of the frame, the frame of the patent of Propst being only slightly larger than the mattress as the frame rests on the bed perimeter structure. However, the width of ordinary covers considerably exceeds the width of the mattress. In said case fixing of the cover to the frame alone does not guarantee complete straightening thereof. Since the cover is not fixed to the lateral portions which exceed the width of the frame, when the frame moves from the horizontal to the vertical position, the ends of the cover, which is made of non-rigid material, are not straightened. This situation means that straightening during descent of the frame cannot be guaranteed. The problem persists also if, as described by Propst, the cover is shaped so that the width at the feet (where the cover is fixed) is narrower than the width at the head (where the cover is left free), since the part of the cover outside the fixing area can assume various positions, hence the final positioning of the cover continues to be uncertain.

The aim of the present invention is to overcome the drawback described by proposing a bed, in accordance with claim 1, provided with a device suitable for facilitating the straightening of blankets and sheets on the bed, of the type, as described by Propst, with a frame, or surround, that can rotate from a horizontal to a vertical position and vice versa, the axis of rotation being horizontal, transverse with respect to the length of the bed and situated in the vicinity of the head of the bed, means being provided, suitable for hooking the covers, in the highest position of the frame, i.e. to the transverse rod of said frame, when the latter is in the vertical position. Said device is characterised in that it provides a further two short additional rods hinged to the end of said transverse rod of the frame, said short rods being able, in turn, to assume a first position in which they are aligned with said transverse rod, and a second position in which they lie vertically along the sides of the bed when the frame is in the horizontal position and resting on the bed perimeter structure.

Thanks to the short rods hinged to the ends of the transverse rod, the bed-making device is now sufficiently wide to accommodate the covers, including the part exceeding the width of the mattress, so that the covers can be correctly positioned. If the user wishes to completely tuck the covers under the mattress, the covers must be released from the ends of the additional rods, whereas if the covers are left hanging down the sides of the bed, they can remain attached.

In practice the bed in accordance with the invention can be automatically made also using covers wider than the mattress and in general of the width desired by the user, without any particular dimensional or geometrical constraints.

A non-limiting example of the invention will now be described according to a preferred embodiment and with reference to the accompanying figures, in which.

Figure 1A:
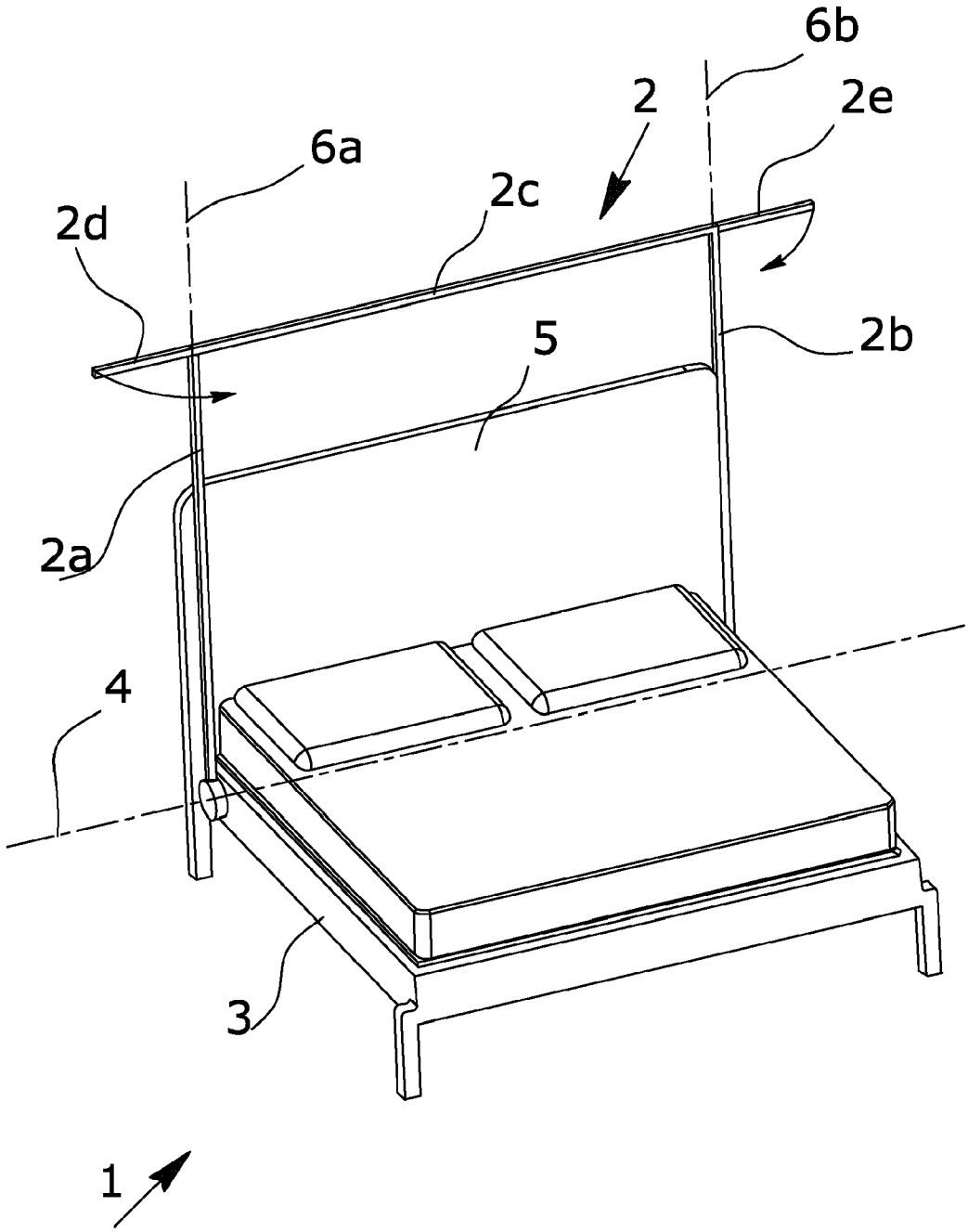
FIGS. 1 (*a, b, c*) show a bed provided with a device according to the invention.

With reference to FIG. 1 (*a, b, c*), (1) indicates a bed provided with a device (2) according to the invention. Said device (2) comprises a frame consisting of two rods (2*a*, 2*b*), hinged at a first end to the structure (3) of the bed so as to rotate around an axis (4), and a third transverse rod (2*c*) which joins the second ends of said two rods (2*a*, 2*b*). Said axis (4) is horizontal, transverse with respect to the direction of the length of the bed and positioned in the vicinity of the head (5) of the bed (1).

Figure 1B:
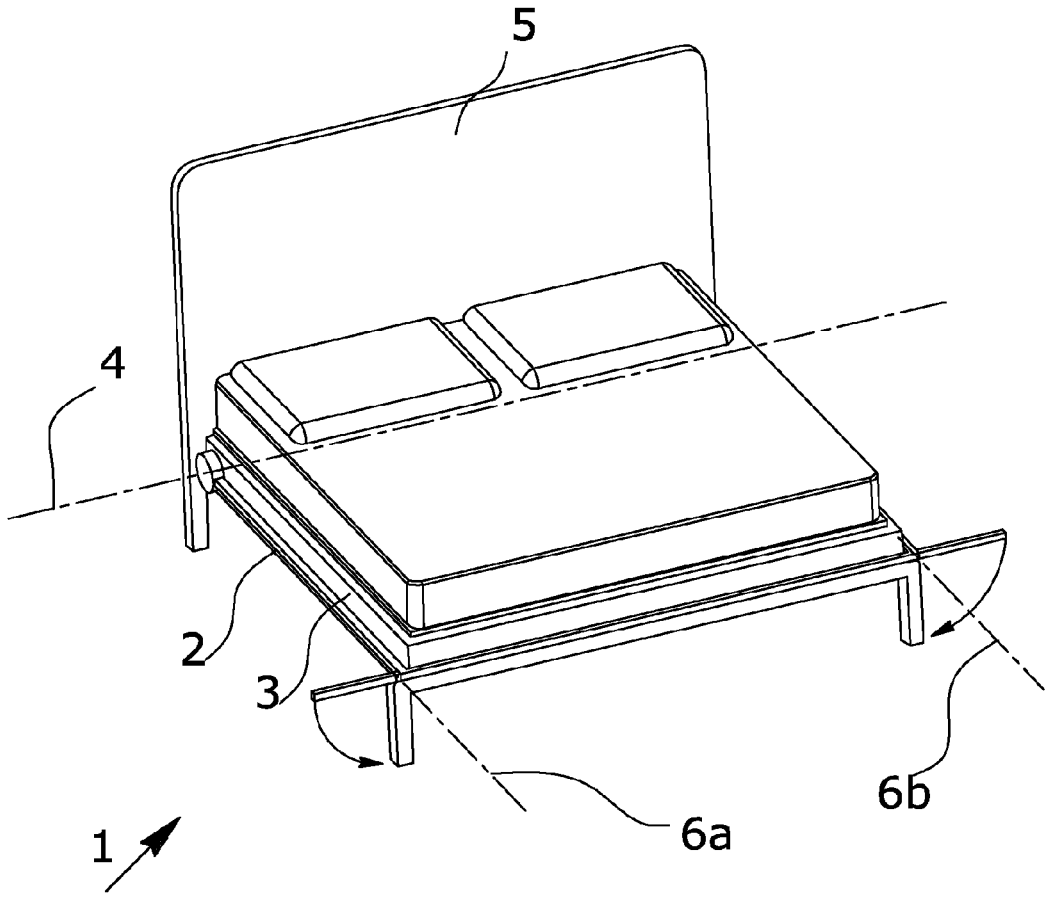

Following rotation around the axis (4), the device (2) can assume two different positions. The first position is obtained when said device (2) is in the vertical position (FIG. 1*a*), while the second position is obtained when it is in the horizontal position (FIG. 1*b*). In said second position the device (2) substantially surrounds the structure (2) of the bed (1), having substantially the same general plan form.

At the second end of said rods (2*a*, 2*b*) two short additional rods are hinged (2*d*, 2*e*) which, in turn, can assume two positions. The first position is obtained when the rods (2*d*, 2*e*) are aligned with the transverse rod (2*c*), while the second position is obtained when, rotating respectively around the axes (6*a*, 6*b*) of the rods (2*a*, 2*b*), they reach the vertical position when the device (2) is in its second position, i.e. in a horizontal position and lying along the structure (3) of the bed (1).

Figure 1C:
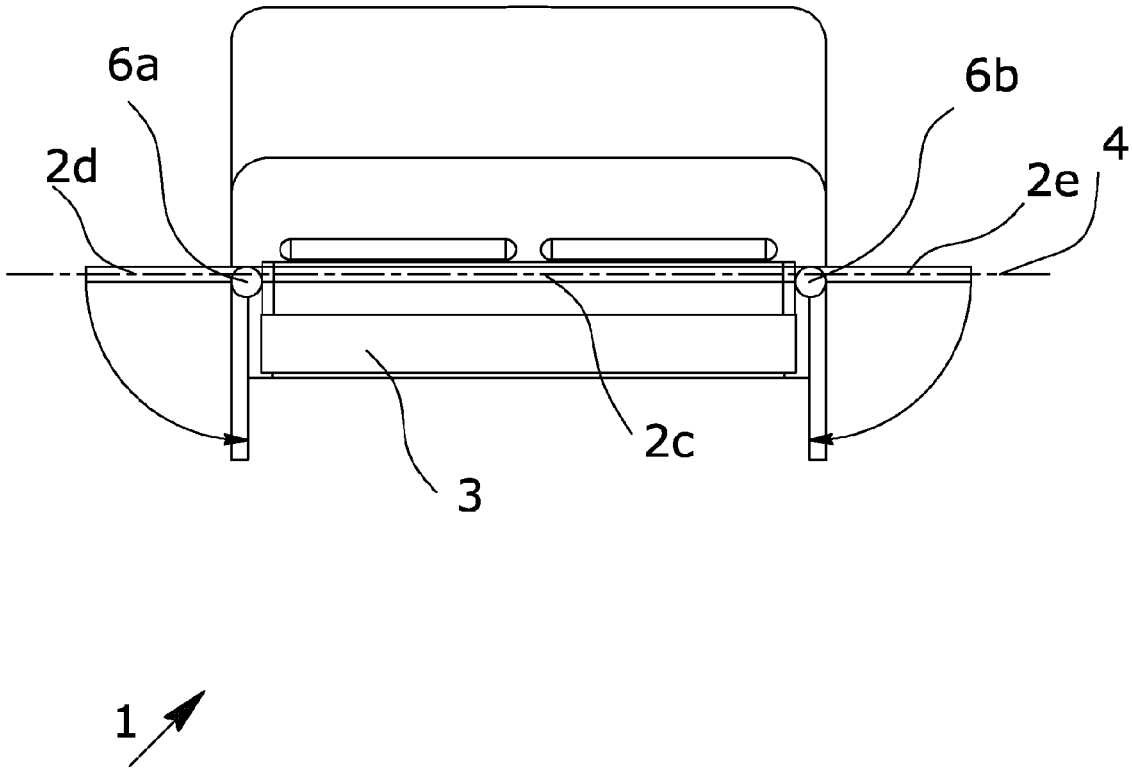

FIG. 1*c* shows a front view of the bed (1), from which it can be seen that the length L of the rods (2*d*, 2*e*) must be less than the height from the floor H of the axis (4) around which the device (2) rotates. In practice the length of the rods (2*d*, 2*e*) must be such that, when they are in their second position, i.e. in a vertical position lying against the structure (3) of the bed (1), their free end is a few centimeters' distance from the floor.

The device (2) is used to straighten the covers (7) on the bed (1), both blankets and sheets. FIG. 2 (*a, b, c*) show the sequence of the operations necessary to straighten said covers (7) on the bed (1).

Figure 2A:
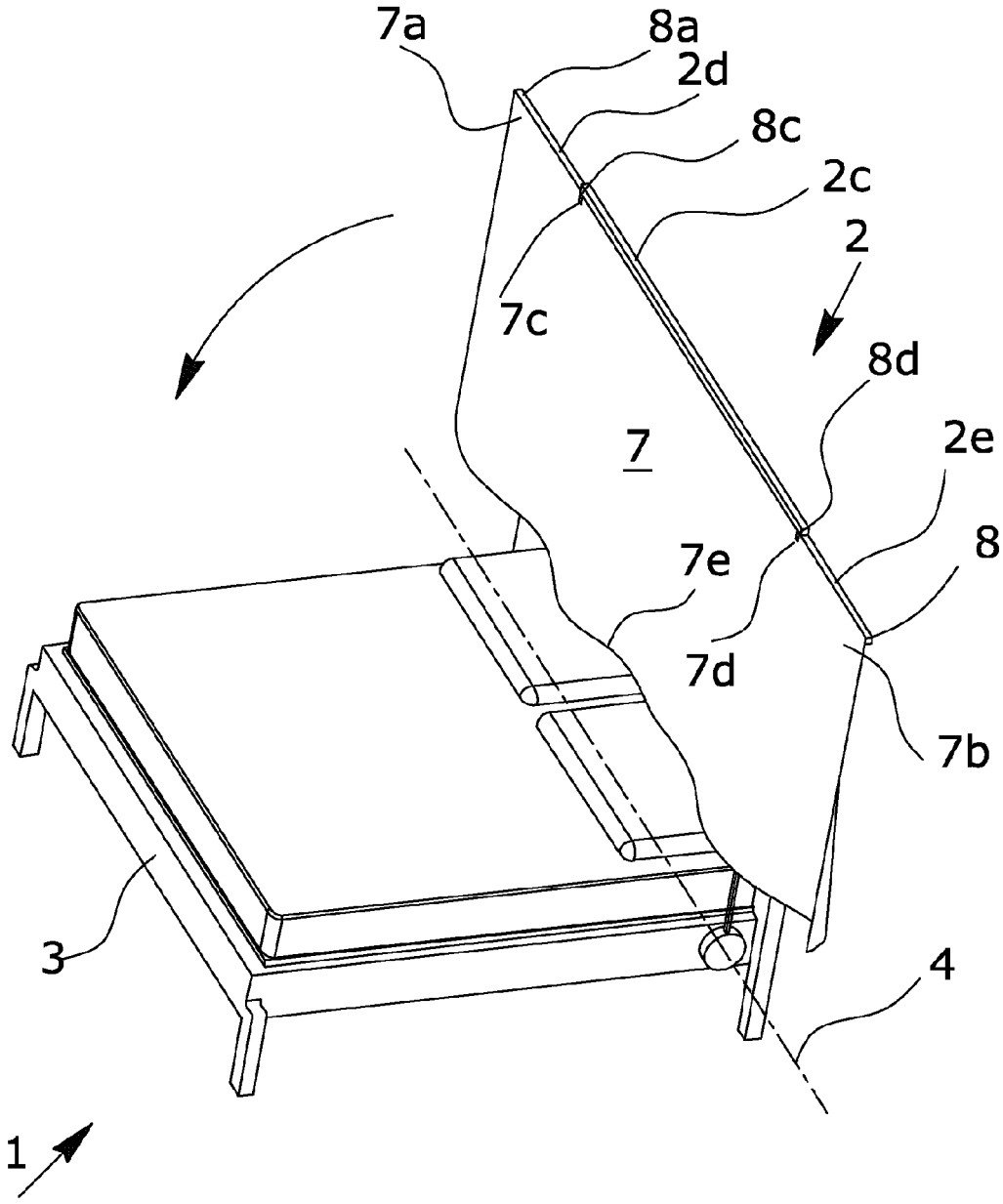
FIGS. 2 (*a, b, c*) show operation of the device according to the invention.

As shown in FIG. 2*a*, a cover (7) is hooked to the device (2) while it is in the vertical position. In particular the ends (7*a*, 7*b*) of the cover (7) are hooked to the free ends of the rods (2*d*, 2*e*) respectively. If the cover (7) is a sheet, hooking at the ends only (7*a*, 7*b*) may be sufficient, whereas if the cover (7) is a heavy blanket, said hooking at the ends only may not be sufficient to keep it straightened. In said case one or more hooks can be provided in intermediate areas (7*c*, 7*d*).

Said hooking operations can be performed since suitable hooking means are provided in the areas concerned (8*a*, 8*b*, 8*c*, 8*d*) of the rods (2*c*, 2*d*, 2*e*) of the device (2), for example grippers of known type (not shown) suitable for clamping the edges of the cover (7) without damaging it. Alternatively attachment means can be provided on the cover (7), for example tapes that close in a ring formation and are secured in the closed position by means of Velcro.

Figure 2B:
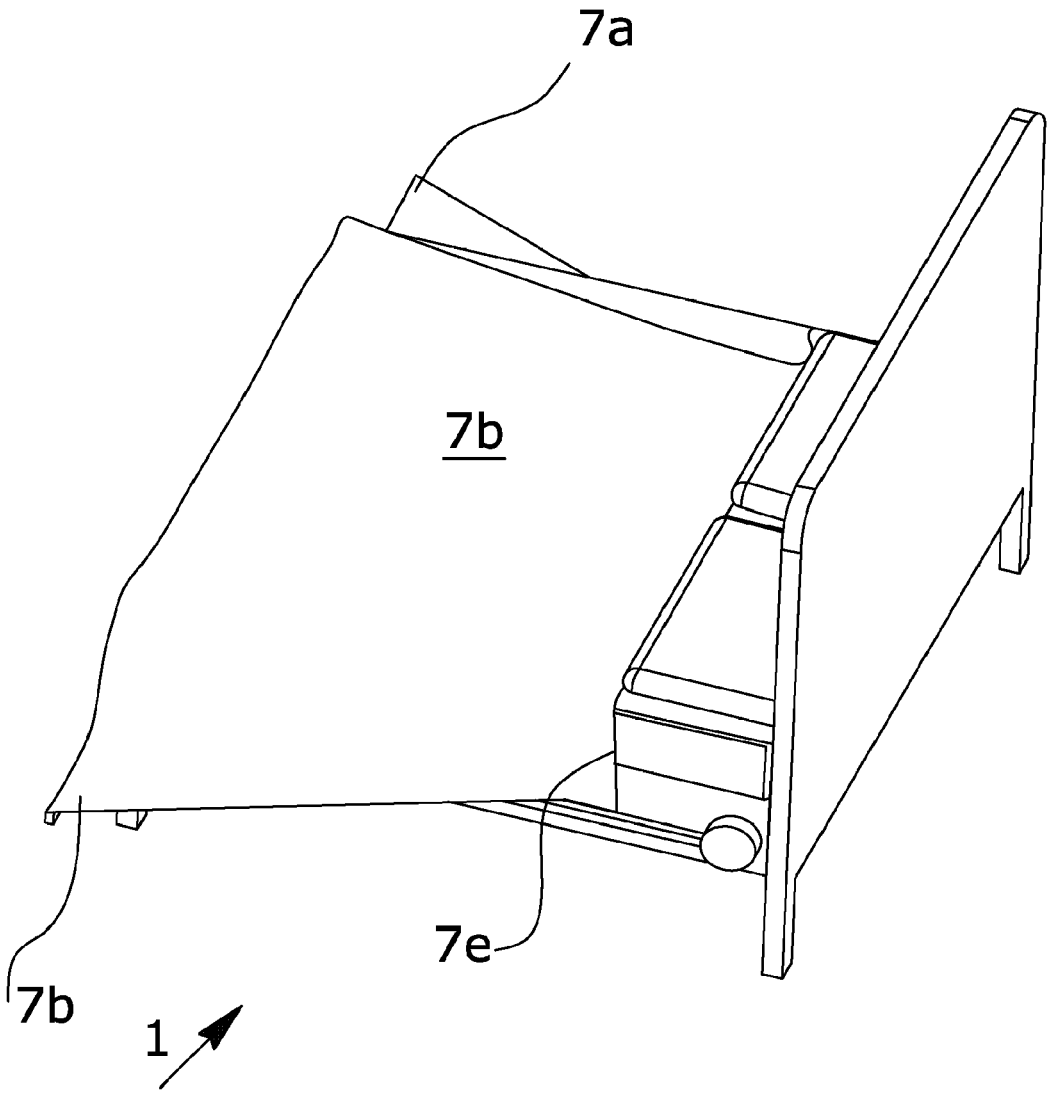
Figure 2C:
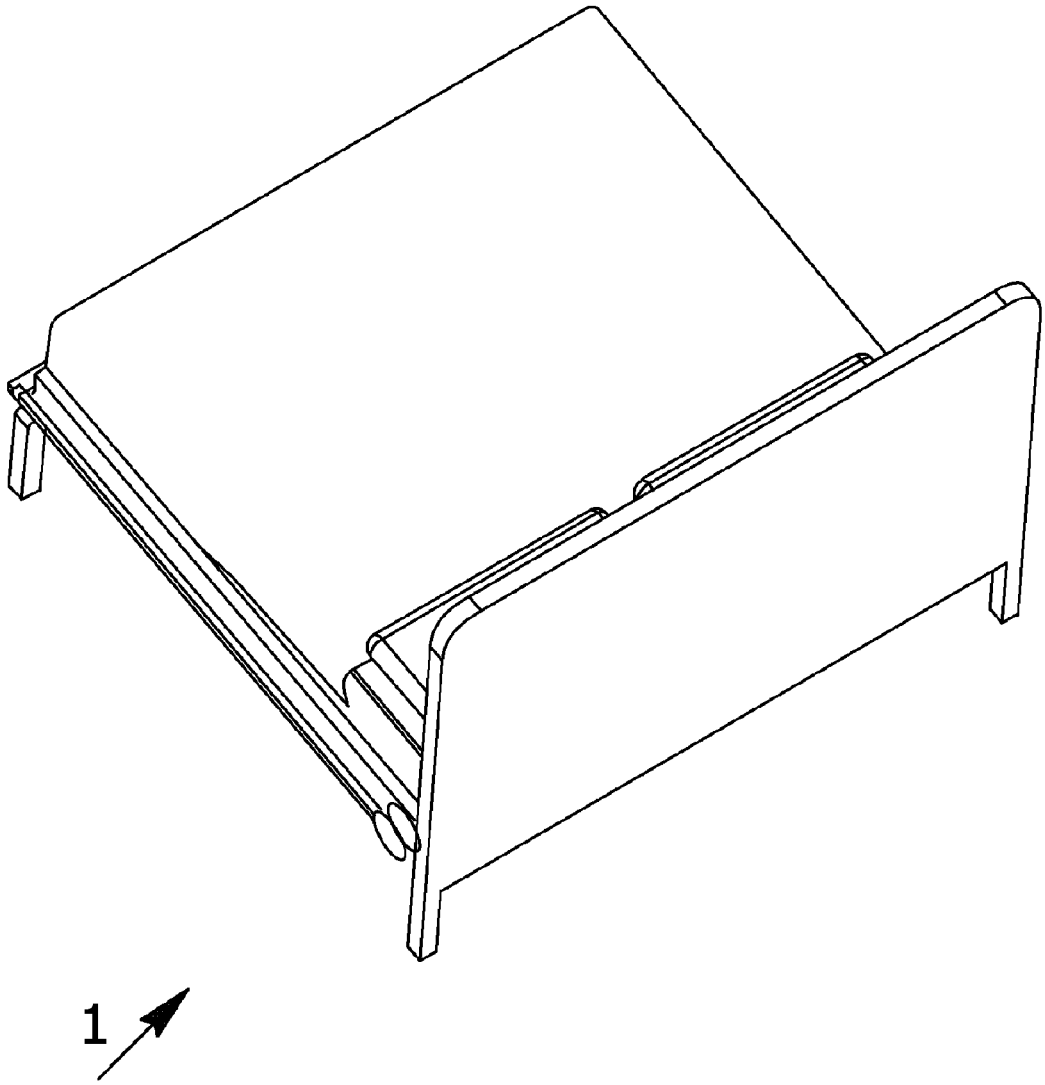

At this point the device (2) is rotated, in the direction indicated by the arrow, so that it lies around the contour of the structure (3) of the bed (1), i.e. setting itself to the position shown in FIG. 2*b*. As a result of this rotation, the cover (7)

assumes its natural position with the parts exceeding the width of the mattress straightened and adjacent to the mattress. In fact, since the ends (7*a*, 7*b*) of the cover (7) are attached respectively to the ends (8*a*, 8*b*) of the rods (2*d*, 2*e*), when the latter rotate around the axes (6*a*, 6*b*), they are brought to within a few centimeters' distance from the floor, in a symmetrical manner with respect to the bed (1). At this point the parts (7*a*, 7*b*, 7*c*, 7*d*) of the cover (7) can be released so as to tuck the cover completely under the mattress, as shown in FIG. 2*c*, or be left attached to the points (8*a*, 8*b*, 8*c*, 8*d*) of the rods (2*c*, 2*d*, 2*e*), ready for the next bed-making operation.

In FIG. 2 (*a, b, c*) the cover (7) shown is a blanket, in fact after rotation of the device (2), its edge (7*e*) is positioned along the edge of the pillows. If the cover (7) is a sheet, it must be attached so that, after rotation of the device (2), its top edge is in a position such that it can be tucked under the mattress in the area of the head (5) of the bed.

In accordance with a second embodiment of the invention (not shown), the short additional rods (2*d*, 2*e*) are not hinged to the ends of the transverse rod (2*c*) of the device (2) but, by means of a sliding coupling, they can assume a position in which they do not protrude from said third transverse rod (2*c*), said position being obtained by telescopic retraction inside said third transverse rod (2*c*) or by sliding on it in a linear manner.

In this case all the bed-making operations can be performed exactly as described above. At the end of the operations it will obviously be necessary to release the covers from the ends of the additional rods and retract them inside the transverse rod (2*c*).

As appears clear from the preceding description, the bed-making operation is made very easy by the device (2) according to the invention, since the operation for straightening the cover (7) becomes very simple and rapid; the cover, set to the correct position, can be rapidly tucked under the mattress or left as it is after the straightening operation performed by the device (2).

A non-limiting example of the invention has been described according to a preferred embodiment. A person skilled in the art will be able to devise numerous other embodiments, all falling within the protective scope of the following claims.

The invention claimed is:

1. Bed (1) provided with a device (2) for making the bed, the device having a frame, or surround, comprising two rods (2*a*, 2*b*) each having a first end and a second end and a third transverse rod (2*c*) which joins the second ends of said two rods (2*a*, 2*b*), the two rods and the third transverse rod capable of rotating around an axis (4) from a horizontal to a vertical position and vice versa, the axis of rotation (4) being horizontal, transverse with respect to the length of the bed and situated in the vicinity of the head (5) of the bed; means are provided suitable for hooking a cover (7) in the highest position of the frame, i.e. to said third transverse rod (2*c*) of said frame, when the latter is in the vertical position, said device (2) being characterised in that a further two short additional rods (2*d*, 2*e*) are provided, connected to ends of said transverse rod of the frame, said additional rods (2*d*, 2*e*) being able, in turn, to assume a first position when said additional rods (2*d*, 2*e*) are aligned with said transverse rod (2*c*) so as to constitute an extension of said transverse rod (2*c*) suitable for gripping a part of said cover (7) and exceeding a width of the mattress on said bed (1).

2. Bed (1) provided with a device (2), according to claim 1, characterised in that said short additional rods (2*d*, 2*e*) are connected to said third transverse rod (2*c*) by means of hinges suitable for permitting the rotation of said additional rods (2*d*, 2*e*) around axes (6*a*, 6*b*) defined by said two rods (2*a*, 2*b*), so that said additional rods (2*d*, 2*e*) can assume a second position in which they lie vertically along the sides of the bed (1) when said frame is in the horizontal position and lying along the perimeter (3) of the bed (1).

3. Bed (1) provided with a device (2), according to claim 1, characterised in that said short additional rods (2*d*, 2*e*) are connected to said third transverse rod (2*c*) by means of a sliding coupling, so that said additional rods (2*d*, 2*e*) can assume a second position in which they do not protrude from said third transverse rod (2*c*), said second position being obtained by telescopic retraction inside said third transverse rod (2*c*) or by sliding in a linear manner on said third transverse rod (2*c*).

* * * * *